US008734176B2

(12) United States Patent
Ishimaru

(10) Patent No.: US 8,734,176 B2
(45) Date of Patent: May 27, 2014

(54) ELECTRICAL CONNECTOR

(75) Inventor: Masao Ishimaru, Machida (JP)

(73) Assignee: Dai-Ichi Seiko Co., Ltd., Kyoto-shi (JP)

( * ) Notice: Subject to any disclaimer, the term of this patent is extended or adjusted under 35 U.S.C. 154(b) by 31 days.

(21) Appl. No.: 13/495,479

(22) Filed: Jun. 13, 2012

(65) Prior Publication Data

US 2013/0005174 A1 Jan. 3, 2013

(30) Foreign Application Priority Data

Jun. 29, 2011 (JP) ..... 2011-143992
Nov. 29, 2011 (JP) ..... 2011-260078

(51) Int. Cl.
*H01R 13/62* (2006.01)

(52) U.S. Cl.
USPC ..... 439/328; 439/352

(58) Field of Classification Search
USPC ..... 439/325–328, 352
IPC ..... H01R 12/7005,23/7005, 23/7068, 23/682; H05K 7/1405, 7/1409
See application file for complete search history.

(56) References Cited

U.S. PATENT DOCUMENTS 5,885,097 A * 3/1999 Chen ..... 439/328
6,231,364 B1 * 5/2001 Liu ..... 439/326
6,503,093 B1 * 1/2003 Sakata et al. ..... 439/328
6,932,633 B2 * 8/2005 Tsai ..... 439/160
8,235,740 B2 * 8/2012 Tsai ..... 439/328
2012/0100742 A1 4/2012 Ishimaru
2012/0214329 A1 8/2012 Ishimaru

FOREIGN PATENT DOCUMENTS

JP 2001-196130 7/2001
JP 2003-100370 4/2003

OTHER PUBLICATIONS

U.S. Appl. No. 29/397,662, filed Jul. 19, 2011, Ishimaru.
U.S. Appl. No. 29/459,877, filed Jul. 3, 2013, Ishimaru.

* cited by examiner

*Primary Examiner* — Hien Vu
(74) *Attorney, Agent, or Firm* — Oblon, Spivak, McClelland, Maier & Neustadt, L.L.P.

(57) ABSTRACT

A signal transmission medium inserted into an insulating housing can be held and released in a favorable manner with a simple structure. A pair of lock release parts are arranged to face opposite each other at both outer ends of a signal transmission medium, this pair of lock release parts being integrally and continuously formed to release arms integrally extending from the insulating housing to be movable to approach and separate from each other, with a lock release link mechanism being provided for causing the locking portion to displace in an unlocking direction by moving the pair of lock release parts in directions approaching each other.

7 Claims, 12 Drawing Sheets

ELECTRICAL CONNECTOR

BACKGROUND OF THE INVENTION

1. Field of the Invention

The present invention relates to an electrical connector configured to hold a signal transmission medium inserted inside the body of the connector with a locking portion.

2. Description of the Related Art

Conventionally, electrical connectors electrically connecting a signal transmission medium such as a flexible flat cable (FFC) or a flexible printed circuit (FPC) to a circuit/wiring board have widely been adopted in various electrical devices and the like. The electrical connector is mounted on the circuit/wiring board via a board connecting leg (hold-down), for example, joined to the board so that the body of the connector stands upright from the surface of the circuit/wiring board. A signal transmission medium is inserted into the electrical connector from an insertion opening formed in the connector body for establishing electrical connection.

Some electrical connectors, specifically known as Non-Zif type, often employ an automatic locking mechanism for the signal transmission medium to stay inserted, with a locking portion provided in the electrical connector engaging with a positioning portion, which is for example a cut-out recess, provided to a terminal portion at the inserted end of the signal transmission medium inserted into the connector.

Conventional electrical connectors of this type (Japanese Patent Application Laid-Open No. 2001-196130) often employ a configuration that does not use a slider for achieving a necessary contact pressure between contacts held inside the connector and respective lands on the signal transmission medium (FPC) but instead uses a pivotally mounted lock lever that can prevent the signal transmission medium from coming off even with a small contact load. Since the locking portion provided to the connector body is a separate component, such a configuration tends to increase the entire cost of the connector due to an increase in the number of components. Another problem is that the locking portion is configured to engage with the signal transmission medium by its own weight, because of which the signal transmission medium cannot be held with a sufficient retaining force.

Another configuration proposed for conventional connectors (Japanese Patent Application Laid-Open No. 2003-100370) uses resilient support pieces provided to metal reinforcing parts attached to both ends of the housing and soldered to the circuit/wiring board for resiliently pressing and supporting the signal transmission medium (FPC) to prevent the FPC from displacing out of position. However, since the pressing force from the resilient support pieces is applied in a direction offset from the position where the metal reinforcing parts are soldered, after unlocking of the locking portion is repeated a number of times, the mounting state of the connector body may be adversely affected by the unlocking force continuously applied thereto, which may make the electrical connection unstable.

SUMMARY OF THE INVENTION

Accordingly, an object of the present invention is to provide an electrical connector capable of favorably holding and releasing a signal transmission medium inserted into an insulating housing with a simple structure.

To achieve the above object, an electrical connector according to the present invention is configured with a locking portion for holding a signal transmission medium inserted into an insulating housing by engaging with both end portions in a plate width direction of the signal transmission medium, the locking portion being released from engagement by a lock release part being operated. The lock release part is provided in a pair to face opposite each other, each disposed at either outer end sandwiching the signal transmission medium in the plate width direction. The pair of lock release parts are continuous with release arms integrally extending from the insulating housing in a cantilevered manner, and configured to be movable to approach and separate from each other by a resilient displacement of the release arms. The lock release parts include a lock release link mechanism for causing the locking portion to displace in an unlocking direction when the pair of lock release parts are moved in directions approaching each other.

In such a configuration, the pair of lock release parts disposed at both outer ends of the signal transmission medium are formed integrally with the insulating housing via the release arms, so that the number of components of the lock release link mechanism for displacing the locking portion is reduced and the structure is simplified. Unlocking of the locking portion is carried out easily and reliably by pressing the pair of lock release parts in directions approaching each other between, for example, the fingers of an operator.

In the present invention, the lock release link mechanism is preferably formed by a locking member integrally having the locking portion, and a release pressure portion provided to the lock release parts so as to contact and separate from the locking member. The locking member preferably includes a lock arm supporting the locking portion in a resiliently displaceable manner, and a release force receiving plate integrally extending from the lock arm in a direction inclined to a moving direction of the lock release parts. The release pressure portion provided to the lock release parts is preferably disposed to be able to contact the release force receiving plate when the pair of lock release parts are moved in directions approaching each other, so that the locking portion is pushed open with the lock arm in an unlocking direction by the contact force applied from the release pressure portion to the release force receiving plate.

With such a configuration, the lock arm is displaced resiliently via the release force receiving plate by the contacting action of the release pressure portion provided to the lock release parts, thereby to unlock the locking portion, so that the locking portion is unlocked reliably with a relatively small force.

The release arms in the present invention are preferably provided with a slide support slidably contacting part of the locking member or part of the insulating housing at least when the lock release parts are being moved.

With such a configuration, the release arms undergo resilient displacement in the unlocking operation while being supported on the locking member or insulating housing via the slide support, so that the unlocking operation is made stable and smooth.

In the present invention, the lock arm is preferably formed as a pivoting member extending from a base of the locking member in a cantilevered manner, and the locking portion is provided to a pivoted end of the lock arm. The lock arm may, for example, preferably extend from the base of the locking member and be folded back in a substantially U-shaped form.

With such a configuration, even though the lock arm is housed in a relatively small space due to the downsizing of the electrical connector, the lock arm can have a long span, which allows favorable resilient deformation of the lock arm and allows the engagement and release of the locking portion to be performed smoothly.

Preferably, the base of the locking member in the present invention is integrally and continuously formed with a board connecting portion soldered to a printed wiring board.

With such a configuration, the unlocking force applied from the lock release parts to the release force receiving plate is directly received by the board connecting portion, so that the strength of the entire electrical connector is maintained favorably.

The insulating housing in the present invention preferably has a lock arm housing cavity housing the lock arm such as to be pivotable, and the lock arm housing cavity preferably has a pivot restricting wall restricting the pivot range of the locking portion by contacting part of the lock arm when the lock arm is pivoted.

With such a configuration, the displacement of the lock arm, i.e., of the locking portion, during the unlocking operation of the lock release parts, is restricted by the pivot restricting wall not to exceed a certain amount, so that, while the locking portion is allowed to protrude toward the signal transmission medium an appropriate amount, breakage or damage to the locking portion and its lock release link mechanism, and to the signal transmission medium is prevented. The lock arm is positioned such that, when the signal transmission medium is completely inserted and the lock arm returns to its initial state, part of the lock arm lightly abuts on the pivot restricting wall, whereby a sound known as a click indicating the completion of insertion can be generated, so that a situation where the signal transmission medium is left incompletely inserted is prevented. Moreover, should a pulling-out force be applied to the completely inserted signal transmission medium, the pivot restricting wall can stop the lock arm from pivoting in the unlocking direction of the locking portion, so that the signal transmission medium is prevented from coming off.

The locking member in the present invention preferably includes a return spring piece integrally formed therewith imparting a resilient restoring force to the lock release parts.

With such a configuration, after the lock release parts are operated, the resilient restoring force of the return spring piece is supplementarily provided to the lock release parts in addition to the restoring force by a resilient displacement of the release arms, so that the lock release parts are reliably returned to their initial positions from the position where they unlock the locking portion, and a situation where the locking portion remains unstable because of the lock release parts not being returned can be avoided.

As described above, the electrical connector according to the present invention includes a pair of lock release parts for releasing engagement of a locking portion disposed to face opposite each other at both outer ends of a signal transmission medium, this pair of lock release parts being integrally and continuously formed to release arms integrally extending from an insulating housing to be movable to approach and separate from each other, and includes a lock release link mechanism for displacing a locking member in an unlocking direction by moving both lock release parts to approach each other. Thereby, the number of components for the lock release link mechanism for displacing the locking portion is reduced to simplify the structure, and the locking portion can be unlocked reliably by an easy operation of the pair of lock release parts. The signal transmission medium inserted into the insulating housing can therefore be favorably held and released with a simple structure, as a result of which the reliability of the electrical connector can be improved significantly at low cost.

DESCRIPTION OF THE PREFERRED EMBODIMENTS

Figure 1:
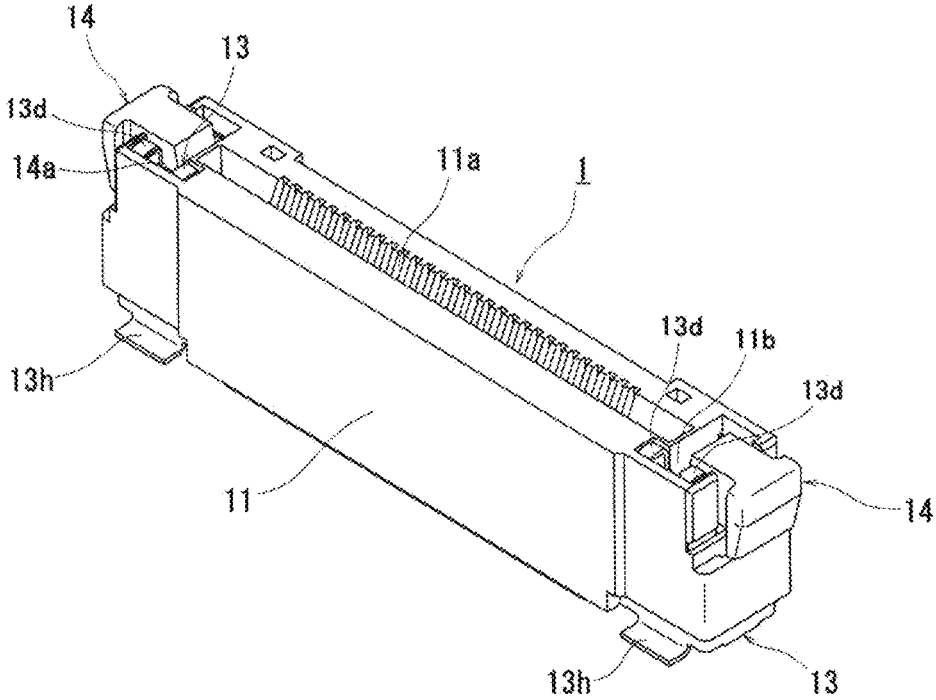
FIG. 1 is an external perspective illustration of an electrical connector according to a first embodiment of the present invention, illustrating the structure from the front side.
Figure 2:
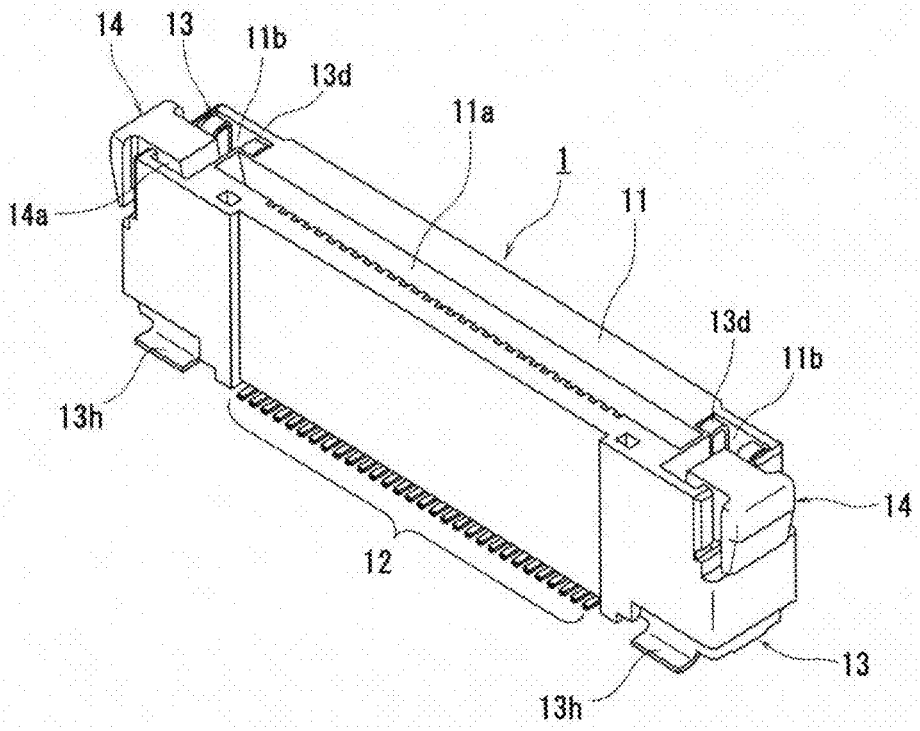
FIG. 2 is an external perspective illustration of the electrical connector shown in FIG. 1, illustrating the connector from the backside.
Figure 3:
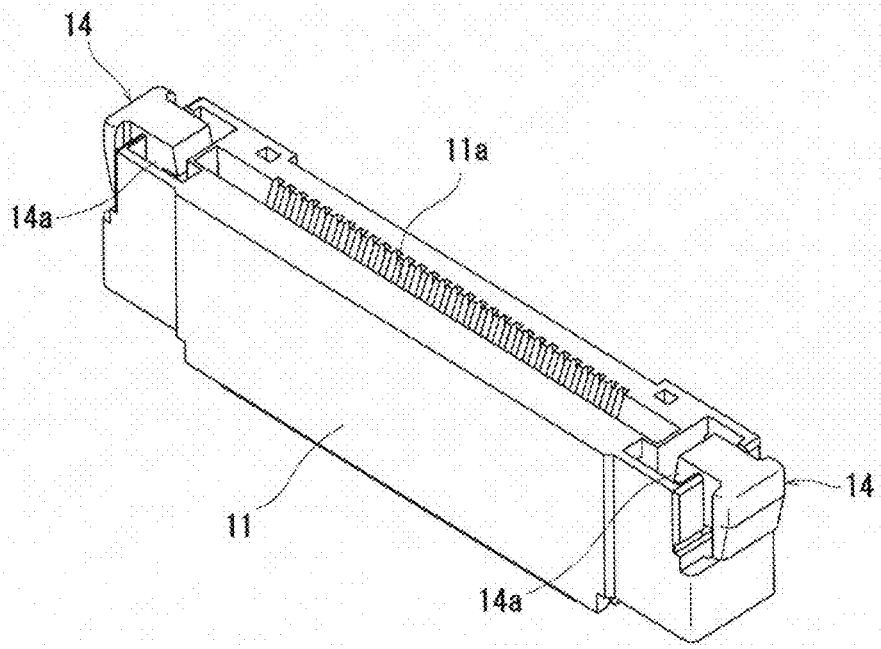
FIG. 3 is an external perspective illustration of the electrical connector shown in FIG. 1 without a locking member.
Figure 4:
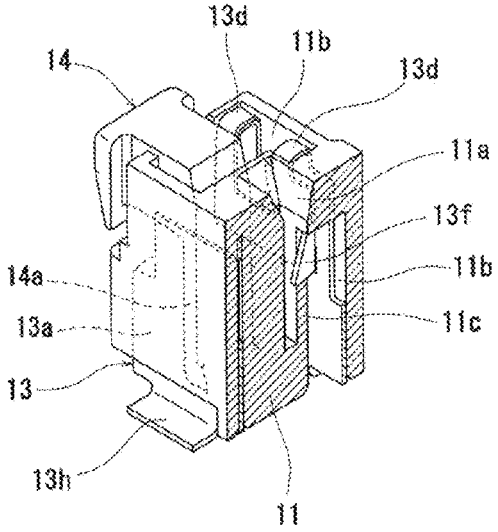
FIG. 4 is a partially enlarged perspective illustration of the structure at one longitudinal end of the electrical connector shown in FIG. 1 to FIG. 3.
Figure 5:
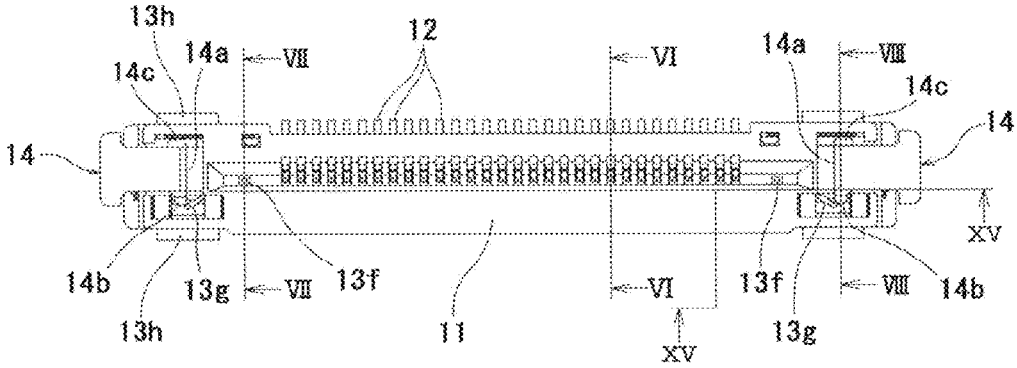
FIG. 5 is a plan illustration of the electrical connector shown in FIG. 1 to FIG. 3.
Figure 6:
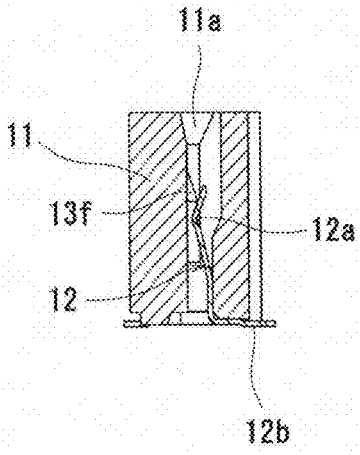
FIG. 6 is a cross-sectional illustration along VI-VI in FIG. 5, illustrating the electrical connector shown in FIG. 1 to FIG. 5.

Embodiments of the present invention applied to a receptacle connector mounted on a circuit/wiring board will be described below in detail based on the drawings.

The receptacle connector 1 according to the first embodiment of the present invention shown in FIG. 1 to FIG. 14 is an electrical connector commonly known as a Non-Zif connector mounted on a circuit/wiring board (not shown) forming part of an electronic circuit of an electrical product. The receptacle connector 1 includes an insulating housing 11 of an elongated shape disposed upright from the surface of the substantially horizontally arranged circuit/wiring board.

Hereinafter, it is supposed that the surface of the circuit/wiring board (not shown) extends horizontally, and the direction in which the insulating housing 11 stands up from the surface of the circuit/wiring board will be referred to as "upward direction", while the direction opposite from the upstanding direction of the insulating housing 11 will be referred to as "downward direction". The direction in which the elongated insulating housing 11 extends will be referred to as "connector longitudinal direction", while the direction orthogonal to both of this "connector longitudinal direction" and the "upward and downward directions" will be referred to as "connector width direction".

[Insulating Housing]

In the upper end face at the upright end of the insulating housing 11 is formed an insertion opening 11*a* in the form of a narrow slot along the connector longitudinal direction for receiving a signal transmission medium PB such as a flexible flat cable (FFC) or flexible printed circuit (FPC) to be described later. A signal transmission medium PB is set generally orthogonal to the surface of the circuit/wiring board (not shown) above this insertion opening 11*a* with its terminal portion facing downward (FIG. 12), and as this terminal portion of the signal transmission medium PB is lowered, it is inserted into the receptacle connector 1 through the insertion opening 11*a*, more specifically into the hollow space inside the insulating housing 11.

With such a structure in which the signal transmission medium PB (FFC or FPC) is inserted from above, the positional relationship between the insertion opening 11*a* and the signal transmission medium PB can be readily observed from above when inserting the signal transmission medium PB into the insertion opening 11*a* of the insulating housing 11, so that the insertion of the signal transmission medium PB can be performed easily and correctly, and also the signal transmission medium PB is kept in a favorable condition after insertion.

[Conductive Contact]

A larger number of conductive contacts (conductive terminals) 12, 12 . . . are attached in the insulating housing 11 in a multipole manner along the connector longitudinal direction of the insulating housing 11 at predetermined intervals. Each conductive contact 12 is made of a metal part bent in a generally L-shape when viewed from the side as shown particularly in FIG. 6, and has a contact point 12*a* in an upper end portion to contact a corresponding terminal portion of the signal transmission medium PB (FFC or FPC) inserted into the receptacle connector 1 as described above. The body of each conductive contact 12 extends downward from the contact point 12*a*, bends generally at right angles at a lower end portion where it contacts the circuit/wiring board (not shown), and protrudes to the backside in the connector width direction (right side in FIG. 6). A connection terminal 12*b* is provided at this portion of the conductive contact 12 protruding rearward, this connection terminal 12*b* being soldered to a signal conduction path formed in the circuit/wiring board (not shown).

[Locking Member]

A pair of locking members (hold-down) 13, 13 formed of a thin metal plate member bent into a predetermined shape are disposed at both ends in the connector longitudinal direction of the insulating housing 11. These locking members 13 are each attached to either end in the connector longitudinal direction of the insulating housing 11 from below upwards, and each include, as shown particularly in FIG. 9, a pair of lock bases (base) 13*a*, 13*a*, as the base of the respective locking members 13, standing up from the bottom surface of the insulating housing 11 such as to face each other in the connector width direction. These lock bases 13*a*, 13*a* are coupled to each other by a base connection plate 13*b* in the connector width direction to be integral at an end in the connector longitudinal direction. A plurality of housing retainer pieces 13*c* are provided on these lock bases 13*a* and base connection plate 13*b* such as to protrude upward. These plurality of housing retainer pieces 13*c* are press-fitted into the body of the insulating housing 11 from the bottom side upward so as to secure the entire locking member 13.

A pair of lock arms 13*e*, 13*e* are provided to the upper end edge of one lock base 13*a* located on the front side (left side in FIG. 8) in the connector width direction via folded-back portions 13*d*, 13*d* such as to form resiliently displaceable pivot members. These folded-back portions 13*d*, 13*d* and lock arms 13*e*, 13*e* are arranged adjacent each other along the connector longitudinal direction. Each folded-back portion 13*d* is bent to have a generally inverted U-shape when viewed from the side, protruded once upward from the upper end edge of the lock base 13*a* and then folded back to invert downward. The lock arms 13*e* each extend downward from the lower ends of the respective folded-back portions 13*d* in a cantilevered manner, this cantilever structure allowing the respective lock arms 13*e* to resiliently pivot in the connector width direction about the folded-back portions 13*d* as the fulcrum. The lower ends of both lock arms 13*e*, 13*e* are coupled to each other to be integral in the connector longitudinal direction so that both lock arms 13*e*, 13*e* pivot integrally.

A locking portion 13*f* for holding the signal transmission medium PB (FFC or FPC) is provided to a side edge of one of the pair of lock arms 13*e*, 13*e* located on the inner side of the connector. This locking portion 13*f* engages with a positioning portion PB1 formed in a terminal portion of the signal transmission medium PB (FFC or FPC). These components will be described in detail later.

Figure 7:
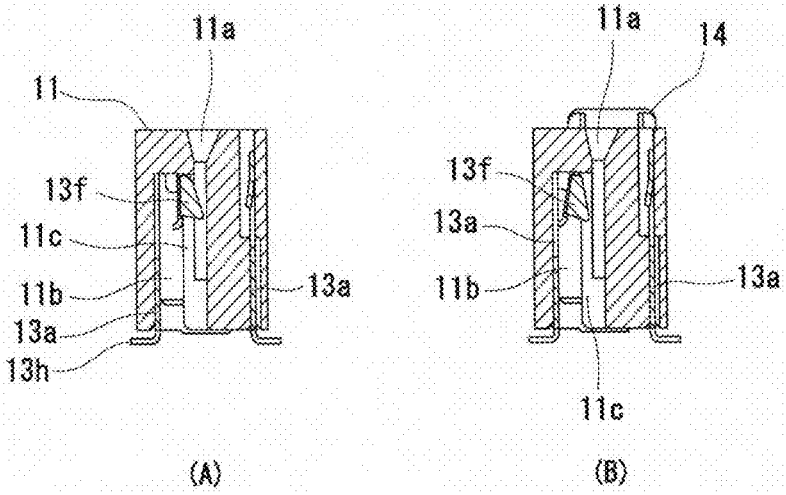
FIG. 7A and FIG. 7B illustrate the electrical connector shown in FIG. 1 to FIG. 5, FIG. 7A being a cross-sectional illustration along VII-VII in FIG. 5 and FIG. 7B being a cross-sectional illustration after an unlocking operation is performed to the connector in the state of FIG. 7A.
Figure 8:
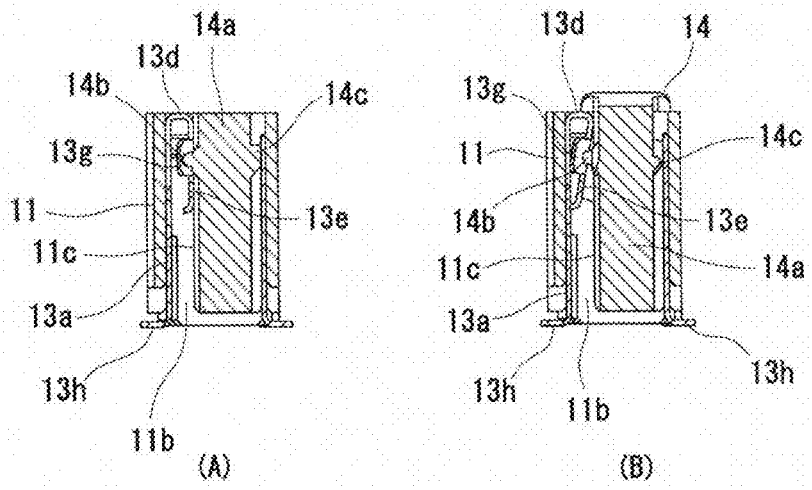
FIG. 8A and FIG. 8B illustrate the electrical connector shown in FIG. 1 to FIG. 5, FIG. 8A being a cross-sectional illustration along VIII-VIII in FIG. 5 and FIG. 8B being a cross-sectional illustration after an unlocking operation is performed to the connector in the state of FIG. 8A.
Figure 9:
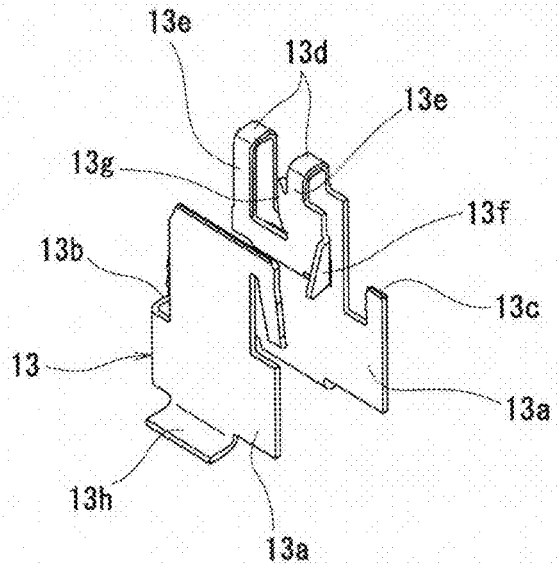
FIG. 9 is an external perspective illustration of the structure of one of the locking members used in the electrical connector shown in FIG. 1 to FIG. 5 viewed from inside the connector.

Inside the insulating housing 11, on the other hand, is provided a lock arm housing cavity 11*b* for housing the pair of lock arms 13*e*, 13*e* and the locking portion 13*f* such as to allow them to pivot, as shown particularly in FIG. 7 and FIG. 8. This lock arm housing cavity 11*b* includes a pivot restricting wall 11*c* dividing the insulating housing to define the lock arm housing cavity 11*b* and the space for receiving the signal transmission medium PB (FFC or FPC). This pivot restricting wall 11*c* is disposed relative to the lock arms 13*e* such as to allow the lock arms to contact the wall, so that the pivot motion of the locking portion 13*f* is restricted within a suitable range.

In this embodiment, in particular, the wall is disposed relative to the lock arms 13*e* such that, when the lock arms 13*e* with the locking portion 13*f* return resiliently to their initial unloaded state after being pivoted, part of the lock arms 13*e* lightly collides against the pivot restricting wall 11*c*, making a sound commonly referred to as a click.

The pivot restricting wall 11*c* further includes a slit-like cut-out in a portion facing the locking portion 13*f*, so as to allow the tip of the locking portion 13*f* to protrude through this cut-out into the space for receiving the signal transmission medium PB provided inside the insulating housing 11.

[Locking Portion]

This locking portion 13*f* is provided corresponding to the positioning portion PB1 formed in a terminal portion of the signal transmission medium PB (FFC or FPC). Namely, as shown particularly in FIG. 12, the positioning portions PB1 in the form of a cut-out notch are formed in the terminal portion of the signal transmission medium PB one each at either side edge in the plate width direction (connector longitudinal direction). When the signal transmission medium PB is inserted into the receptacle connector 1, the locking portions 13*f* provided in the receptacle connector 1 as described above engage with the positioning portions PB1 provided to the signal transmission medium PB, so that the signal transmission medium PB is kept inserted by this engagement between the positioning portions PB1 and locking portions 13*f*.

Each locking portion 13*f* is formed of a plate member entering into the positioning portion PB1 of the signal transmission medium PB (FFC or FPC) as described above, and bent to protrude from the pivoting end of the lock arm 13*e* toward inside the space for receiving the signal transmission medium PB. The distal end in the protruding direction of each locking portion 13*f* is formed in a hook shape, with an inclined guiding side obliquely extending from the lower end edge protruding longer to the shorter protruding upper end edge. This lower end edge of the locking portion 13*f* mentioned above extends to form an inclined side slightly lowering toward the protruding direction of the locking portion 13*f* (rightward in FIG. 7). This hook-shaped locking portion 13*f* is provided to the inner side edge of one of the pair of lock arms 13*e*, 13*e* described above that is located on the inner side in the connector longitudinal direction.

While a pair of locking portions 13*f* are provided on the front side in the connector width direction in this embodiment as described above, they may be provided on the backside, or both on the front side and backside, in the connector width direction.

Figure 12:
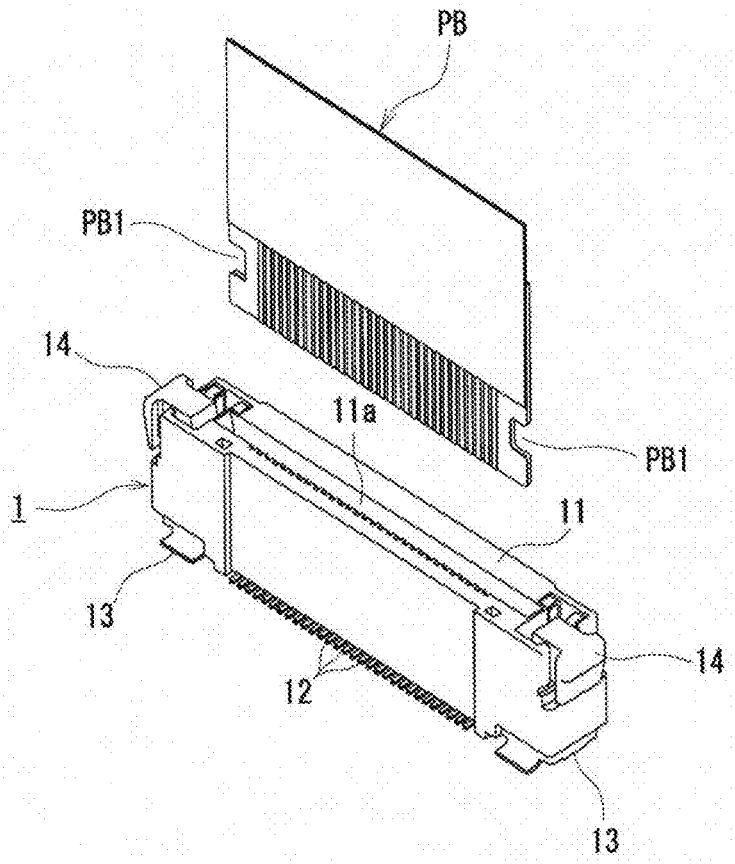
FIG. 12 is an external perspective illustration of a signal transmission medium (FFC) that is going to be inserted into the electrical connector shown in FIG. 1 to FIG. 5.
Figure 13:
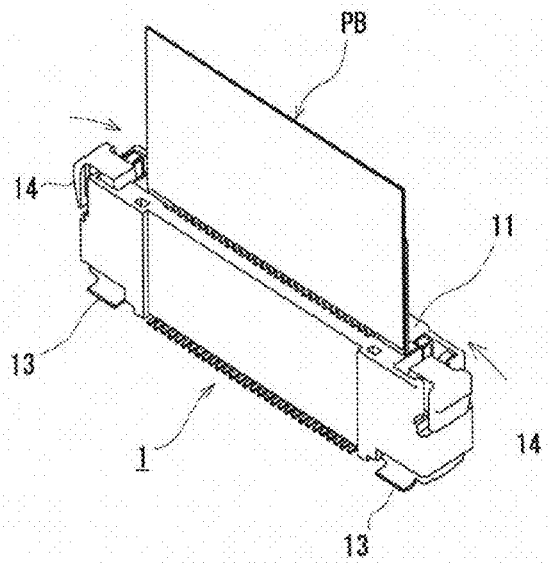
FIG. 13 is an external perspective illustration of the signal transmission medium (FFC) completely inserted into the electrical connector shown in FIG. 1 to FIG. 5.
Figure 14:
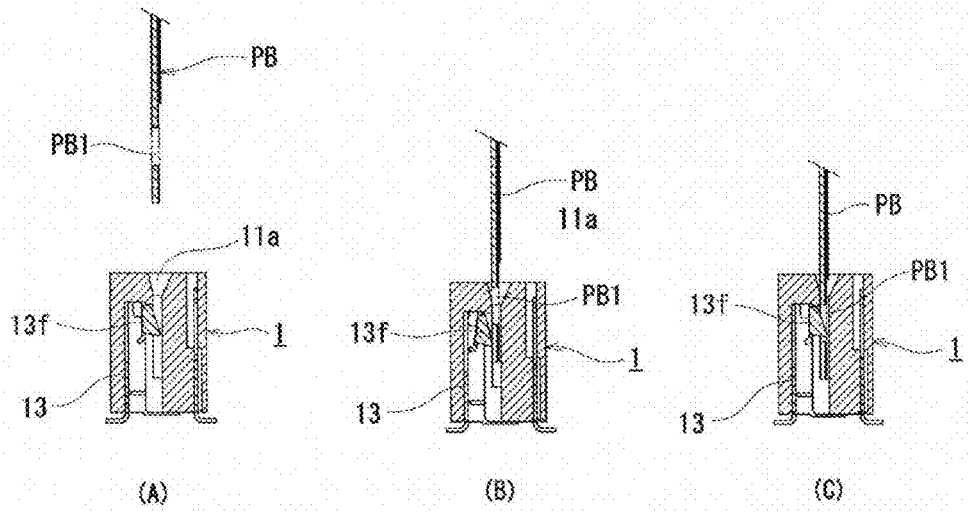
FIG. 14A to FIG. 14C illustrate the insertion process of the signal transmission medium (FFC) into the electrical connector shown in FIG. 1 to FIG. 5, FIG. 14A being a cross-sectional illustration of the locking portion (positioning portion of the signal transmission medium) before insertion of the signal transmission medium (FFC), FIG. 14B being a cross-sectional illustration of the signal transmission medium (FFC) in the middle of insertion, and FIG. 14C being an external perspective illustration of the signal transmission medium (FFC) completely inserted.

When the terminal portion of the signal transmission medium PB (FFC or FPC) is inserted from above into the receiving space of the insulating housing 11 as shown, for example, in FIG. 12 and FIG. 14A, the distal end edge of the signal transmission medium PB being inserted abuts on the inclined guiding sides mentioned above of the locking portions 13*f*, as shown in FIG. 13 and FIG. 14(B), thereby pushing the lock arms 13*e* that extend downward in the initial state before insertion outward in the connector width direction and resiliently displacing the lock arms 13*e* in a pivotal manner about the folded-back portions 13*d* at the upper ends as the fulcrum.

From this state where the lock arms 13*e* are resiliently displaced, when the terminal portion of the signal transmission medium PB (FFC or FPC) is pushed further downward, as shown, for example, in FIG. 14(C), the hook-shaped parts of the locking portions 13*f* mentioned above are pivoted by the resilient restoring force of the lock arms 13*e* to protrude into the positioning portions (cut-out notches) PB1 of the signal transmission medium PB. The locking portions 13*f* thus engage with the positioning portions PB1 of the signal transmission medium PB, whereby the signal transmission medium PB is kept inserted.

When the signal transmission medium PB (FFC or FPC) is completely inserted and the lock arms 13*e* return to their initial state as described above, part of the lock arms 13*e* lightly collides on the pivot restricting walls 11*c* and makes a sound known as a click indicating the completion of insertion, so that a situation where the signal transmission medium PB is left incompletely inserted is prevented. Moreover, should a pulling-out force be applied to the completely inserted signal transmission medium PB, the positioning portions PB1 of the signal transmission medium PB make pressure contact with the inclined sides of the locking portions 13*f* forming the lower end edges thereof, and a component of force generated at the lower end edges formed by the inclined sides causes the locking portions 13*f* together with the lock arms 13*e* to move toward an opposite direction from the unlocking direction. However, such movement of the locking portions 13*f* and lock arms 13*e* is stopped by the lock arms 13*e* abutting on the pivot restricting walls 11*c*, as a result of which the signal transmission medium PB is prevented from being pulled out or coming off.

[Lock Release Link Mechanism]

On the other hand, in the state where the locking portions 13*f* are engaged with the signal transmission medium PB (FFC or FPC) as described above, when lock release parts 14 are operated to release the lock as will be described later, the lock arms 13*e* pivot against their own resilient force by being pressed outward in the connector width direction by a lock release link mechanism to be described next (see FIG. 7B, FIG. 8B, and FIG. 10), thereby allowing the hook-shaped portions of the locking portions 13*f* to be released from the positioning portions PB1 of the signal transmission medium PB. These lock release parts 14 and the lock release link mechanism provided therein will be described next.

The lock release link mechanism is included each in a pair of lock release parts 14, 14 provided for releasing the locking portions 13*f* from the signal transmission medium PB (FFC or FPC). The pair of lock release parts 14, 14 provided with this lock release link mechanism are each disposed at either end in the connector longitudinal direction of the insulating housing 11. The pair of lock release parts 14 are disposed at positions sandwiching the signal transmission medium PB in the plate width direction (connector longitudinal direction), i.e., at both outer ends of the insertion opening 11*a* to face opposite each other, and configured to receive an unlocking force applied in directions in which the pair of lock release parts 14, 14 approach each other, as indicated by arrows in, for example, FIG. 13 and FIG. 15.

Figure 15:
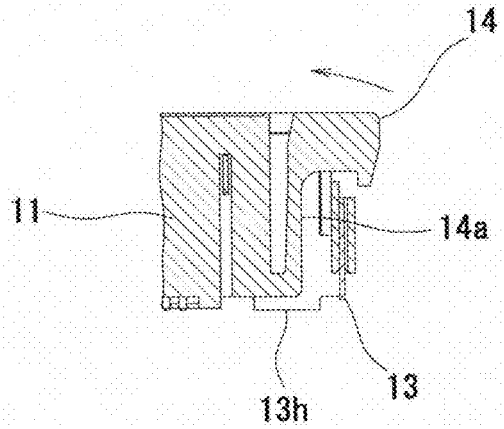
FIG. 15 is a longitudinal cross-sectional illustration along XV-XV in FIG. 5, illustrating the electrical connector shown in FIG. 1 to FIG. 5.

Both lock release parts 14, 14 are integrally formed with the insulating housing 11 via release arms 14*a*, 14*a* at both ends in the connector longitudinal direction of the insulating housing 11, as shown in FIG. 15. More specifically, each release arm 14*a* extends outward in the connector width direction from a bottom part of the insulating housing 11 in a cantilevered manner and then upwards, bent generally at right angles, and the lock release part 14 is formed continuously at the upper end of this generally L-shaped release arm 14*a*. These respective release arms 14*a* can displace resiliently to allow the pair of lock release parts 14, 14 to approach and separate from each other.

In actual unlocking operation, these lock release parts 14, 14 are held, for example, between fingers of an operator, to be moved in directions in which they approach each other as indicated by arrows in FIG. 13. Both lock release parts 14, 14 move apart from each other again by the resilient restoring force of the release arms 14*a* when they are freed from the hand of the operator.

As noted above, a lock release link mechanism is each formed in this pair of lock release parts 14, 14 so that when the lock release parts 14, 14 are brought closer to each other in the unlocking operation, the locking portions 13*f* are moved in the unlocking direction from the signal transmission medium PB (FFC or FPC) via the lock release link mechanisms. Hereinafter, the structure of one of the lock release link mechanisms located at one end in the connector longitudinal direction will be described, and it should be understood that the lock release link mechanism on the other side also has the same structure.

As shown in FIG. 5 and FIG. 9 to FIG. 11, the lock release link mechanism formed in the lock release part 14 includes one of the lock arms 13*e* supporting the locking portion 13*f* in a resiliently displaceable manner, a release force receiving plate 13*g* provided to this one lock arm 13*e*, and a release pressure portion 14*b* provided to the release arm 14*a* and configured to abut on this release force receiving plate 13*g*.

Of these, the release force receiving plate 13*g* is formed by a plate-like member integrally extending from a side edge of one of the lock arms 13*e* located on the inner side in the connector longitudinal direction toward the other lock arm 13*e*. This release force receiving plate 13*g* extends in a direction inclined to the direction of movement of the lock release part 14 (connector longitudinal direction), being disposed to make an angle of about 30 degrees relative to the direction in which both lock release parts 14 approach or separate from each other (connector longitudinal direction) as viewed in plan view.

Corresponding to this release force receiving plate 13*g*, the release pressure portion 14*b* is formed on a side end face on the front side in the connector width direction (left side in FIG. 8) of the release arm 14*a* in a protruding shape projecting toward the release force receiving plate 13*g*. This release pressure portion 14*b* is disposed to be able to contact the release force receiving plate 13*g*, with a positional relationship being such that the release pressure portion 14*b* makes contact with the release force receiving plate 13*g* when the lock release part 14 is operated, while it is located at a position away from the release force receiving plate 13*g* in the connector longitudinal direction in an initial state when the lock release part 14 is not operated.

Figure 10:
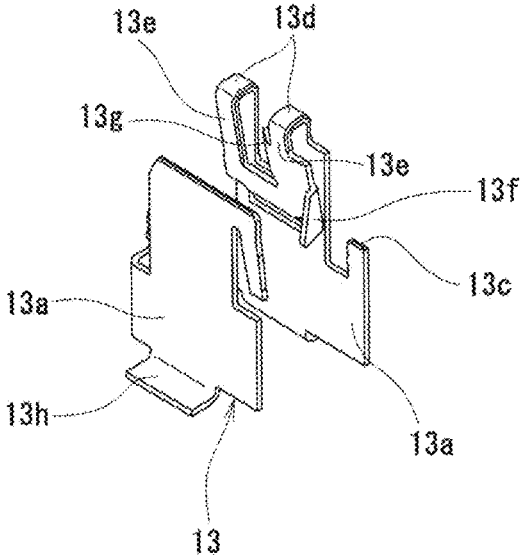
FIG. 10 is an external perspective illustration after an unlocking operation is performed to the locking member shown in FIG. 9.
Figure 11:
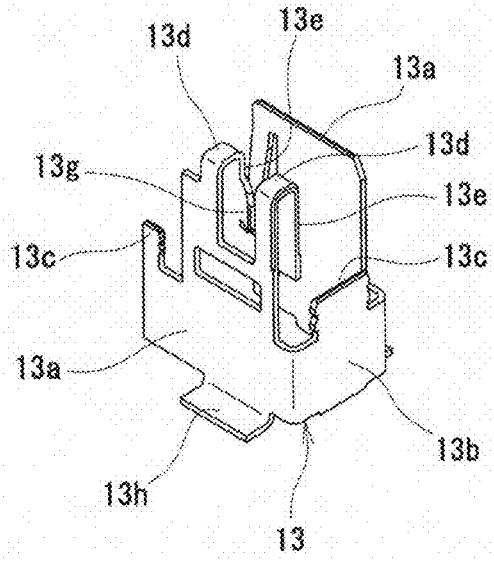
FIG. 11 is an external perspective illustration of the structure of the locking member shown in FIG. 9 viewed from outside the connector.

Namely, when the pair of lock release parts 14, 14 provided at both ends in the connector longitudinal direction are brought closer to each other in the unlocking operation as noted above, the release arms 14*a* displace resiliently in the connector longitudinal direction, corresponding to which the release pressure portions 14*b* come closer to the release force receiving plates 13*g* until the tips of the release pressure portions 14*b* contact the inclined surfaces of the release force receiving plates 13*g*. As both lock release parts 14, 14 are moved further in directions approaching each other, the release pressure portions 14*b* press the inclined surfaces of the release force receiving plates 13*g* outward in the connector width direction, so that the lock arms 13*e*, 13*e* are displaced resiliently with the release force receiving plates 13*g* to be pushed and pivot outward in the connector width direction as shown in FIG. 7B, FIG. 8B, and FIG. 10. As a result, the hook-shaped portions of the locking portions 13*f* come off of the positioning portions PB1 of the signal transmission medium PB, and thus the locking portions 13*f* are released.

The release arm 14*a* in this embodiment is provided with a slide support 14*c* that is a protruding member in the side end face on the backside in the connector width direction (right side in FIG. 8). This slide support 14*c* is configured to make a slidable contact with the surface of the lock base 13*a* located on the backside in the connector width direction (right side in FIG. 8). With this slide support 14*c*, the release arm 14*a* undergoes resilient displacement in the unlocking operation while being supported on the lock base 13*a* via the slide support 14*c*, so that the unlocking operation is made stable and smooth.

The slide support 14*c* may be configured in any other forms such as to make slidable contact with part of the locking member 13, or part of the insulating housing 11, at least during movement of the lock release part 14.

Further, both lock bases 13*a*, 13*a* forming the base of the locking member 13 include board connecting portions 13*h*, 13*h* integrally and continuously formed therewith, bent at right angles and protruding outward in the connector width direction from the respective lower end edges of the lock bases 13*a*, 13*a*. These board connecting portions 13*h*, 13*h* are disposed side by side on a generally straight line along the connector width direction and within a plane containing the release force receiving plate 13*g*, and are soldered on the circuit/wiring board (not shown) so as to rigidly support the force applied in the unlocking operation.

According to this embodiment having such a configuration, the pair of lock release parts 14, 14 disposed on both sides of the signal transmission medium PB (FFC or FPC) are formed integrally with the insulating housing 11 via the release arms 14*a*, 14*a*, so that the number of components of the lock release link mechanisms for displacing the locking portions 13*f* is reduced and the structure is simplified. The unlocking operation of the locking portions 13*f* is carried out easily and reliably by pressing the pair of lock release parts 14, 14 in directions approaching each other between, for example, the fingers of an operator.

In this embodiment, in particular, the lock arms 13*e* are displaced resiliently via the release force receiving plates by the contacting action of the release pressure portions 14*c*, 14*c* of the lock release parts 14, 14, thereby to release the locking portions 13*f*, so that the locking portions 13*f* are released reliably with a relatively small force.

In the configuration of this embodiment, the lock arms 13*e* are accommodated in the lock arm housing cavities 11*b* of the insulating housing 11 which are a relatively small space because of the downsizing of the electrical connector. However, since the lock arms 13*e* are formed as pivoting members extending from the upper end edges of the locking members 13 in a cantilevered manner via the folded-back portions 13*d*, the lock arms 13*e* can have a long span for making the resilient deformation in a favorable manner, so that the engagement and release of the locking portions 13*f* are performed smoothly.

In this embodiment, the unlocking force applied to the release force receiving plates 13*g*, 13*g* from the lock release parts 14 is directly received by the board connecting portions 13*h* connected to the circuit/wiring board, so that the entire electrical connector is hardly subjected to undesirable force and the connection strength of the electrical connector is maintained favorably.

Further, in this embodiment, the lock arm housing cavity 11*b* provided in the insulating housing 11 has the pivot restricting wall 11*c* that abuts part of the lock arms 13*e* when they pivot to restrict the pivot range of the locking portion 13*f*. Therefore the resilient displacement of the lock arms 13*e*, i.e., of the locking portion 13*f*, when the lock release parts 14, 14 are operated, is restricted by the pivot restricting wall 11*c* not to exceed a certain amount, so that, while the locking portion 13*f* is allowed to protrude toward the signal transmission medium PB (FFC or FPC) an appropriate amount, breakage or damage to the locking mechanism including the locking portion 13*f* or its unlocking mechanism and to the signal transmission medium PB is prevented.

When the signal transmission medium PB (FFC or FPC) is completely inserted and the lock arms 13*e* return to their initial positions, part of the lock arms 13*e* abuts on the pivot restricting wall 11*c* and makes a sound known as a click indicating the completion of insertion, so that a situation where the signal transmission medium PB is left incompletely inserted is prevented. Moreover, should a pulling-out force be applied to the completely inserted signal transmission medium PB, the pivot restricting wall 11*c* stops the pivoting of the lock arms 13*e* toward the unlocking direction of the locking portions 13*f*, so that the signal transmission medium PB is prevented from accidentally coming off.

Figure 16:
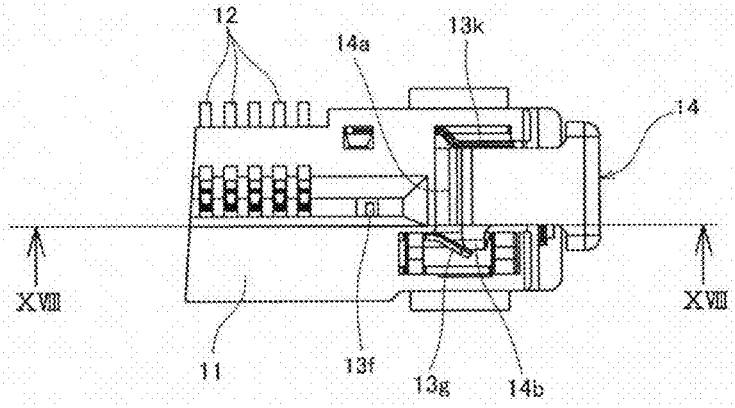
FIG. 16 is a plan illustration of the structure at one longitudinal end of an electrical connector according to a second embodiment of the present invention.
Figure 17:
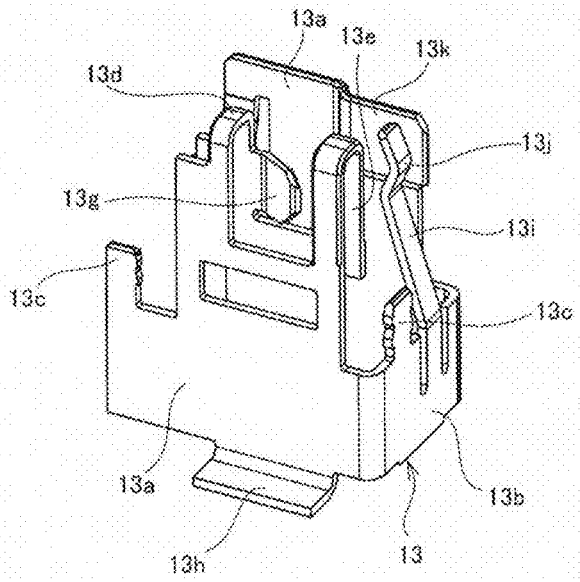
FIG. 17 is an external perspective illustration of the locking member used in the electrical connector according to the second embodiment of the present invention shown in FIG. 16 viewed from outside the connector.
Figure 18:
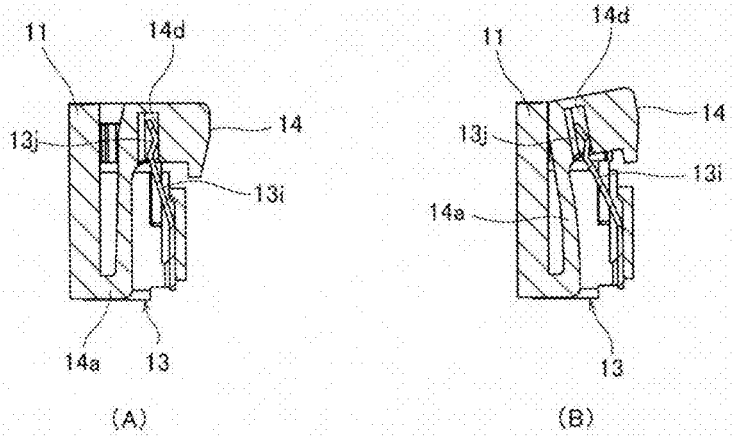
FIG. 18A and FIG. 18B illustrate the electrical connector shown in FIG. 16 to FIG. 17, FIG. 18A being a cross-sectional illustration along XVIII-XVIII in FIG. 16, and FIG. 18B being a cross-sectional illustration after an unlocking operation is performed to the connector in the state of FIG. 18A.

On the other hand, in the second embodiment shown in FIG. 16 to FIG. 18 where the same reference numerals are given to the same constituent elements as those of the previously described first embodiment, the locking members (hold-down) 13 disposed at both ends in the connector longitudinal direction include a return spring piece 13*i* integrally formed therewith for providing the lock release parts 14 a resilient restoring force. This return spring piece 13*i* is a cantilevered member formed to extend integrally upward from the base connection plate 13*b*, which forms the end plate in the connector longitudinal direction of the locking member 13. A hook-shaped inserted fastening portion 13*j* at the upper end of this return spring piece 13*i* is lightly press-fitted to be slidable up and down into a fastening groove 14*d* recessed in the bottom surface of the lock release part 14.

When the lock release part 14, in the initial position (non-operated position) shown in FIG. 18A, is pushed to move toward the center of the connector by the unlocking operation of an operator as shown in FIG. 18B, the return spring piece 13*i* displaces resiliently to tilt toward the center of the connector together with the release arm 14*a* of the lock release part 14. At this time, the hook-shaped inserted fastening portion 13*j* of the return spring piece 13*i* slides inside the fastening groove 14*d* of the lock release part 14 to move relative thereto, so that the lock release part 14 can move smoothly without being obstructed by the return spring piece 13*i*. The lock release part 14 after such unlocking operation is being subjected to the resilient restoring force of the return spring piece 13*i* in addition to the resilient restoring force of the release arm 14*a* so that, when, after this unlocking operation, freed, the lock release part 14 is reliably returned to its initial position.

With the second embodiment, therefore, when the unlocking operation is performed, the resilient restoring force of the return spring piece 13*i* is supplementarily provided to the lock release part 14 in addition to the restoring force of the release arm 14*a*, so that the lock release part 14 is reliably returned to its initial position, and an unstable situation where the locking portion 13*f* remains released because of the lock release part 14 not being returned can be avoided.

In this embodiment, a side portion of the release arm 14*a* makes surface contact with the lock base 13*a* disposed on the backside (upper side in FIG. 16) of the locking member (hold-down) 13. Namely, the slide support 14*c* provided in the side portion of the release arm 14*a* in the previously described first embodiment is not provided in the release arm 14*a* of this embodiment, and instead, the lock base 13*a* has a stepped portion 13*k* having a height corresponding to the protruding height of the slide support 14*c*. The side portion of the release arm 14*a* moves in surface contact with the inner surface of this stepped portion 13*k* provided to the lock base 13*a*.

With such a configuration in which the side portion of the release arm 14*a* makes surface contact with the stepped portion 13*k* of the lock base 13*a*, the lock base 13*a* has no protruding parts that would obstruct the movement of the release arm 14*a*, so that the release arm 14*a* can move reliably in the unlocking operation.

While the invention made by the present inventor has been described in specific terms based on the embodiments, it should be understood that the present invention is not limited to the embodiments described above and can be variously modified without departing from the scope of its subject matter.

For example, while the present invention is applied to a vertical insertion type electrical connector in the embodiments described above, the invention is not limited to this and may be applied similarly to electrical connectors of horizontal insertion type.

The electrical connector according to the present invention is not limited to those for connecting a flexible flat cable (FFC) or a flexible printed circuit (FPC) as in the embodiments described above, and may be applied similarly to various other connectors electrically connecting a board to a board, or a cable to a board.

As described above, the present invention can be widely applied to a variety of electrical connectors used in electrical devices.

What is claimed is:

1. An electrical connector, comprising:

a locking portion to engage with an end portion in a plate width direction of a signal transmission medium inserted into an insulating housing and holding the signal transmission medium;

lock release parts configured to release an engagement of the locking portion; and a lock release link mechanism, wherein the lock release parts include two lock release parts that face each other and are disposed on opposite ends of the insulation housing so the signal transmission medium is disposed between the two lock release parts in the plate width direction when inserted into the insulting housing, wherein each of the lock release parts is continuously formed to with a respective release arm integrally extending from the insulating housing in a cantilevered manner, wherein the lock release parts are configured to be movable to approach and separate from each other by a resilient displacement of the release arms, wherein the lock release parts move in directions approaching each other and the lock release link mechanism causes the locking portion to displace in an unlocking direction, wherein the lock release link mechanism includes a locking member integrally formed with the locking portion and a release pressure portion, the locking member includes a lock arm supporting the locking portion in a resiliently displaceable manner and a release force receiving plate integrally extending from the lock arm in a direction inclined to a moving direction of one of the lock release parts, and the release pressure portion is provided on the one of the lock release parts so as to contact and separate from the locking member, and wherein the release pressure portion is disposed to be able to contact the release force receiving plate when the lock release parts are moved in directions approaching each other and the locking portion displaces with the lock arm in the unlocking direction by a contact force applied from the release pressure portion to the release force receiving plate.

2. The electrical connector according to claim 1, wherein at least one of the release arms is provided with a slide support slidably contacting part of the locking member or part of the insulating housing at least when the lock release parts are being moved.

3. The electrical connector according to claim 1, wherein the lock arm is formed as a pivoting member extending from a base of the locking member in a cantilevered manner, and the locking portion being provided on a pivoted end of the lock arm.

4. The electrical connector according to claim 1, wherein the lock arm extends from a base of the locking member and is folded back in a substantially U-shaped form.

5. The electrical connector according to claim 1, wherein a base of the locking member is integrally formed with a board connecting portion soldered to a printed wiring board.

6. The electrical connector according to claim 1, wherein the insulating housing has a lock arm housing cavity housing the lock arm such as to be pivotable, the lock arm housing cavity having a pivot restricting wall restricting a pivot range of the locking portion by contacting part of the lock arm when the lock arm is pivoted.

7. The electrical connector according to claim 1, wherein the locking member includes a return spring piece integrally formed therewith imparting a resilient restoring force to the one of the lock release parts.

* * * * *